US005504386A

United States Patent [19]

Kyushima et al.

[11] Patent Number: 5,504,386

[45] Date of Patent: Apr. 2, 1996

[54] PHOTOMULTIPLIER TUBE HAVING A METAL-MADE SIDEWALL

[75] Inventors: Hiroyuki Kyushima; Yutaka Hasegawa; Masuo Ito; Junichi Takeuchi; Koichiro Oba, all of Hamamatsu, Japan

[73] Assignee: Hamamatsu Photonics K. K., Shizuoka, Japan

[21] Appl. No.: 29,227

[22] Filed: Mar. 9, 1993

[30] Foreign Application Priority Data

Apr. 9, 1992 [JP] Japan ..... 4-088922

[51] Int. Cl.[6] ..... H01J 40/14

[52] U.S. Cl. ..... 313/103R; 313/103 CM; 313/532; 313/544

[58] Field of Search ..... 313/103 R, 103 C M, 313/541, 544, 540, 532

[56] References Cited

U.S. PATENT DOCUMENTS

| | | | |
|---|---|---|---|
| 3,567,948 | 4/1969 | Oke et al. | 250/216 |
| 3,757,151 | 9/1973 | Ace | 313/39 |
| 3,868,524 | 2/1975 | Stahl | 313/544 |
| 4,376,246 | 3/1983 | Butterwick | 250/270 |
| 4,431,943 | 2/1984 | Faulkner et al. | 313/541 X |
| 4,554,481 | 11/1985 | Faulkner et al. | 313/533 |
| 4,998,037 | 3/1991 | Kerkhof et al. | 313/103 C M |
| 5,077,504 | 12/1991 | Helvy | 313/103 |
| 5,120,949 | 6/1992 | Tomasetti | 313/532 X |

*Primary Examiner*—Sandra L. O'Shea
*Assistant Examiner*—Vip Patel
*Attorney, Agent, or Firm*—Sughrue, Mion, Zinn, Macpeak & Seas

[57] ABSTRACT

A photomultiplier tube which obtains a large decrease in manufacture time, prevents generation of gas within the envelope, prevents deterioration of electron multiplier assembly (dynodes), and greatly reduces noise. The envelope includes an all-metal cylindrical sidewall, at one end of which is an annular, flange-shaped, metal sealing area. The stem of the photomultiplier tube has another annular flange-shaped, metal sealing area. These two sealing areas are welded together. Also a metal exhaust tube is connected to the stem by resistance welding. The metal exhaust tube is severed using pinch-off seal at the final stage of the photomultiplier tube production.

30 Claims, 11 Drawing Sheets

PHOTOMULTIPLIER TUBE HAVING A METAL-MADE SIDEWALL

BACKGROUND OF THE INVENTION

1. Field of the Invention

The present invention relates to a photomultiplier tube, and more particularly to a photomultiplier tube wherein the sidewall of the photomultiplier tube envelope is made of a metal.

2. Description of the Prior Art

There has been proposed a box-shaped photomultiplier tube as shown in FIG. 1 comprising an evacuated envelope 1 (made entirely of glass) having a generally cylindrical, disc-shaped, transparent faceplate 3, a generally cylindrical sidewall 2, and a generally cylindrical, disc-shaped stem 4. The faceplate 3 is hermetically attached to one opening of the cylindrical sidewall 2. A photocathode 5 is formed on the interior surface of the transparent faceplate 3 using alkali metal vaporization techniques. The photocathode 5 provides photoelectrons in response to radiation incident thereon. The stem 4 is vacuum sealed to the lower opening of the cylindrical sidewall 2 e.g., by welding or heat-melt-bonding. Inside the envelope 1 is provided an electron multiplier assembly 8 comprising a plurality of dynodes. Each dynode is provided with a secondary electron emissive surface for multiplying the photoelectrons incident thereon.

As shown in FIG. 1, the stem 4 is formed from a generally cylindrical glass disc 4A. A plurality of stem leads 6 (only some of which are shown) extend through the glass disc 4A into the envelope 1 for supplying voltages to the dynodes and the photocathode 5.

In the center of the glass disc 4*a* is a heat sealed glass exhaust tube 7 protruding vertically downward. During manufacture of the photomultiplier tube and before being heat sealed, the glass exhaust tube 7 provides communication between the interior of the photomultiplier and an exhaust system (not shown). The exhaust system evacuates the envelope 1 via the glass exhaust tube 7, and then alkali metal vapor is introduced into the envelope 1 through the glass exhaust tube 7 for forming the photocathode 5. The glass exhaust tube 7 is unnecessary after production of the photomultiplier tube is complete, and so is severed at the final stage of photomultiplier tube manufacture by using a gas burner so as to be maximally shortened.

The cylindrical sidewall 2 of conventional photomultiplier tubes is heated to melting at a sealing portion 2*a* and vacuum sealed to the cylindrical disc-shaped stem 4 thereat. After the glass exhaust tube 7 is connected to the exhaust system, the envelope 1 is evacuated and then alkali metal vapor is introduced into the envelope 1 to form the photocathode 5 and the secondary electron emissive surface of the dynodes. Afterward, the glass exhaust tube 7 is severed from the exhaust system using a gas burner and maximally shortened. Refer to Japanese Laid-open Patent Publications 60-112224, 58-54539, and 60-211758 for more detailed information on photomultiplier tube technology.

In view of the fact that the cylindrical sidewall 2 and the stem 4 of the photomultiplier tube are formed entirely from glass, various problems have been known with conventional photomultiplier tubes.

Firstly, light emanates from the glass caused by radioactive materials such as $K^{40}$ contained within the glass and causes production of noise.

Secondly, floating electrons or ions generated during production of the photomultiplier assembly 8 strike the glass of the cylindrical sidewall or the stem and cause the glass to emit light which also produces unwanted noise.

Thirdly, the photomultiplier assembly 8 is liable to deteriorate because of a high temperature applied thereto when the stem 4 is melted to secure to the opening of the cylindrical sidewall 2 and when the glass exhaust tube 7 is severed by a gas burner.

Fourthly, melting and severing of the glass exhaust tube 7 cause generation and pooling of gas at the interior section of the photomultiplier tube, which in turn prevents forming a good vacuum. Further, severing of the glass exhaust tube 7 requires more than one step which prolongs the manufacturing time.

Finally, changes in heat, especially at the stem 4, brought about when glass is heated for severing the glass exhaust tube 7, generates cracks in the glass, shifts in the alkali metal film, and other undesirable phenomena, which complicate severing and shortening operations of the glass exhaust tube 7.

SUMMARY OF THE INVENTION

It is therefore, an object of the present invention to overcome the above-described drawbacks and to provide a photomultiplier tube wherein production of noise is reduced, the dynodes are prevented from becoming deteriorated, unwanted gasses are prevented from being generated at the time of melting the glass, and a manufacturing efficiency is greatly improved.

To achieve the above and other objects, there is provided a photomultiplier tube which includes a tubular sidewall, a transparent faceplate and a stem. The faceplate is hermetically sealed to a first end of the sidewall, and the stem is hermetically sealed to a second end of the sidewall, so that the sidewall, faceplate and the stem form an airtight chamber. In accordance with the present invention, the sidewall is made entirely of metal. A photocathode is formed on the surface of the faceplate directed inwardly of the airtight chamber. The photocathode produces electrons in response to radiation incident thereon. Within the airtight chamber, there are provided an electron multiplier assembly and an anode. The electron multiplier assembly multiplies the electrons relayed from the photocathode, and the anode receives the multiplied electrons and produces an output signal representative of the radiation incident on the photocathode.

The second end of the metal sidewall includes a flange-shaped sealing portion, and the stem includes a metal flange-shaped, airtight sealing section. The sealing portion of the metal side wall is hermetically sealed to the sealing section of the stem.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
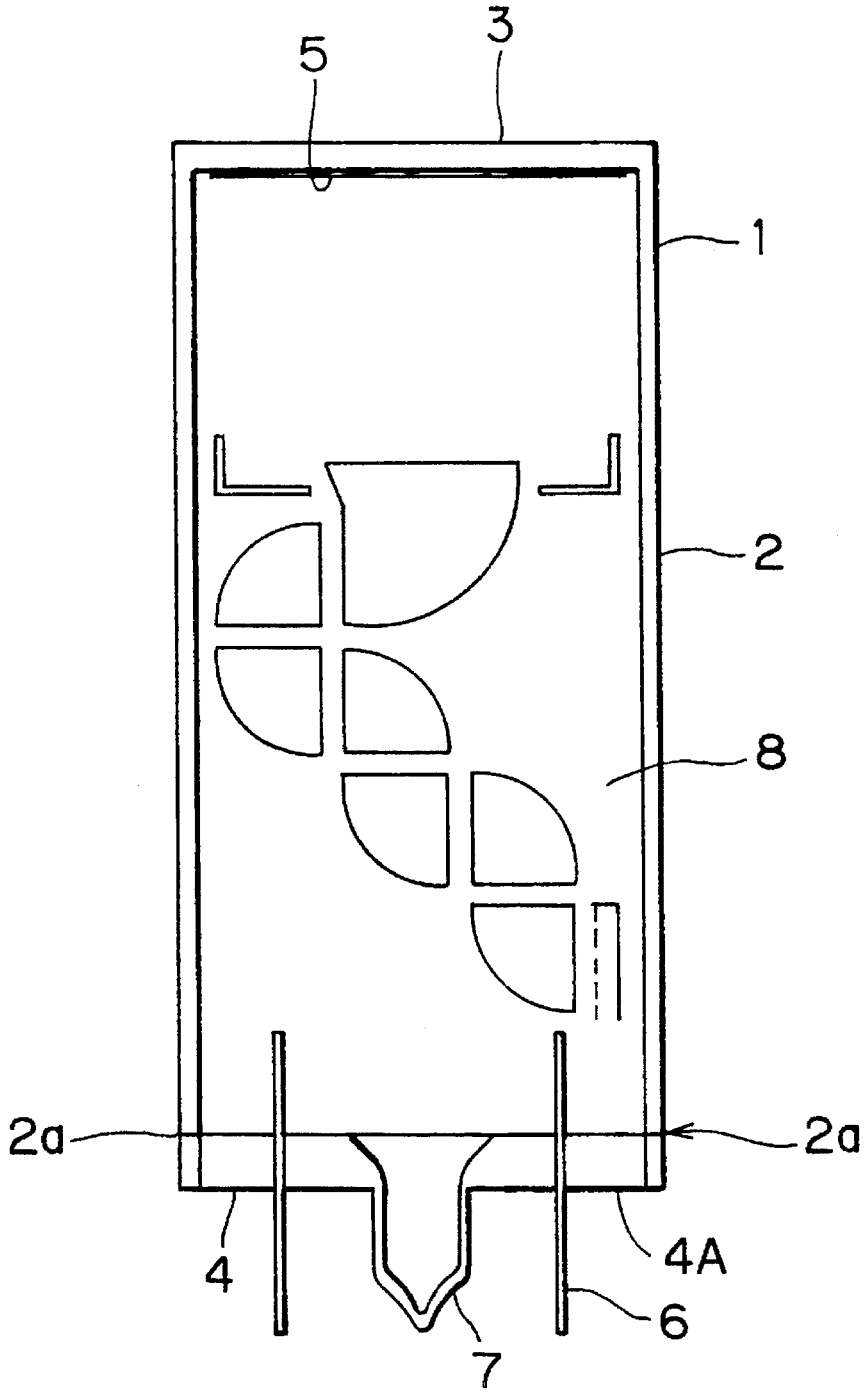
FIG. 1 PRIOR ART
FIG. 1 is a cross-sectional diagram schematically showing a conventional photomultiplier tube.

Referring to the accompanying drawings, preferred embodiments of the invention will be described wherein like parts and components are designated by the same reference numerals to avoid duplicating description.

Figure 2A:
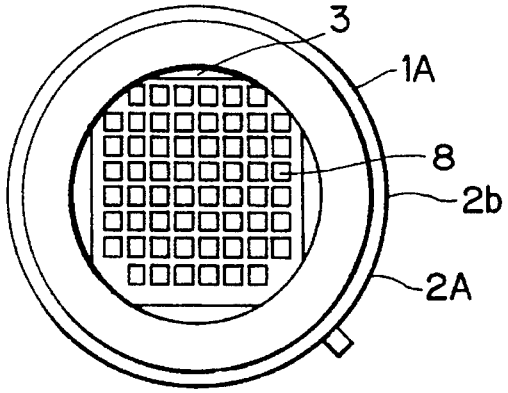
FIGS. 2(*a*), 2(*b*) and 2(*c*) are top plan view, cross-sectional side view and a bottom plan view, respectively, showing a photomultiplier tube according to a first embodiment of the present invention.
Figure 2B:
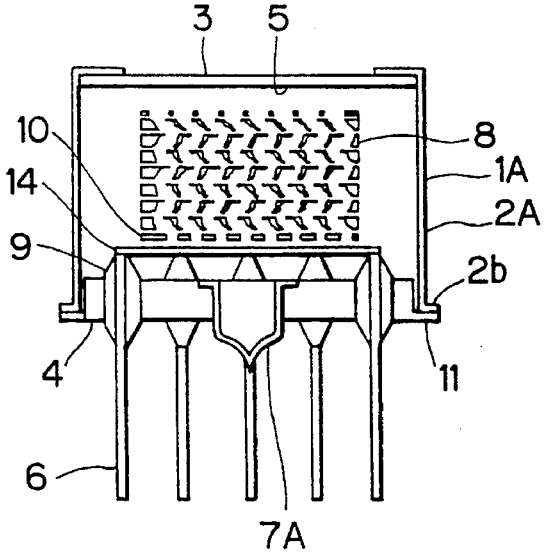
Figure 2C:
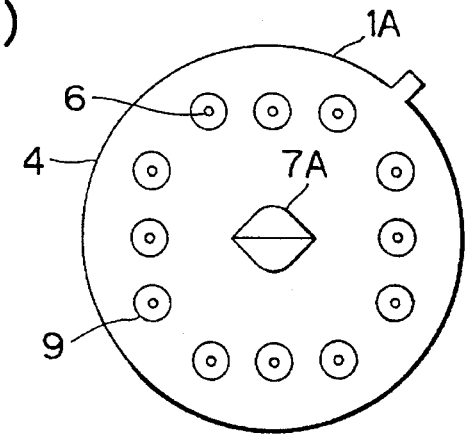

A first embodiment of the photomultipler is shown in FIGS. 2(*a*) through 2(*c*). As shown therein, a photocathode 5 is provided in the inner upper surface of an envelope 1A for producing photoelectrons in response to radiation incident thereon. Inside the envelope 1A is provided an electron multiplier assembly 8 for multiplying the photoelectrons relayed from the photocathode 5. The multiplier assembly 8 includes a plurality of dynodes arranged vertically in a number of stages. Each stage includes a set of dynodes arranged in a two-dimensional matrix form or in one-dimensional array. The multiplier assembly 8 is disclosed in detail in the co-pending U.S. application Ser. No. 07/996,693, issued as U.S. Pat. No. 5,120,949 and is intended to be specifically incorporated herein by reference.

As shown in FIG. 2(*b*), the envelope 1A includes a generally cylindrical, disc-shaped, transparent faceplate 3 with a photocathode 5 deposited on its under surface, a generally-cylindrical sidewall 2A made entirely of metal, an outwardly-protruding, flange-shaped, annular sealing area 2*b*, and a generally cylindrical, disc-shaped stem 4. Preferably, the metal used for the sidewall 2A is of high magnetic permeability to impose external electric and magnetic shielding capability thereon. At one opening of the cylindrical sidewall 2A is a radially inwardly protruding, annular rim to the underside of which the faceplate 3 is annularly attached to form a hermetic seal. The sealing area 2*b* is at the other opening of the sidewall 2A and is hermetically sealed to the stem 4 using a high-frequency heating device or an electric furnace.

As can be seen from FIG. 2(*b*), a plurality of stem leads 6 for supplying voltages to the photocathode 5, dynodes and anode 10 extend through tapered hermetic glasses 9 and are vacuum sealed thereto. As can be seen from FIG. 2(*c*), the stem leads 6 are distributed substantially in a rectangular pattern. The photocathode 5 and the sidewall 2A are held at the same voltage. As can be seen from FIG. 2(*b*), the final-stage dynode's electrode 14 is horizontally held immediately below an anode 10 and immediately above the upper portions of the stem leads 6 protruding into the envelope 1A. Two of the stem leads 6 are connected to the electrode 14. The hermetic glass 9 is voltage proof but is tapered to reserve a longer distance between adjacent two hermetic glasses so that a leak current does not flow. When the operating voltage is low, the hermetic glass 9 need not be tapered but be cylindrical. Regardless of the level of the 10 operating voltage, increment of the diameter of the envelope can prevent the leak current from flowing.

As can be seen from FIG. 2(*b*), in the center of the stem 4 is a flared, downward-protruding metal exhaust tube 7A. Although FIG. 2(*b*) shows the metal exhaust tube 7A after being sealed using resistance welding techniques, before being sealed, the metal exhaust tube 7A connects the photomultiplier tube with an exhaust system made from, for example, a vacuum pump (not shown). Because the metal exhaust tube 7A is unnecessary after the photomultiplier tube has been produced, it can be severed using cold welding techniques at the final stage of producing the photomultiplier tube.

As is also shown in FIGS. 2(*a*) through 2(*c*), the stem 4 includes a metal, radially outwardly protruding, flange-like, annular portion 11. After the annular portion 11 is aligned with the sealing area 2*b*, the two are welded together using helium arc or resistance welding techniques. On the inner surface of the dynodes in the multiplier assembly 8 is formed a secondary electron emitting surface (not shown).

A photomultiplier tube made according to the present invention has the sealing area 2*b* aligned with the flange-like annular portion 11. Once aligned, the two are welded together to form a vacuum seal using helium arc or resistance welding techniques. When this process is completed, the metal exhaust tube 7A is connected to the exhaust system which evacuates the envelope 1A. While the exhaust system evacuates the envelope 1A via the metal exhaust tube 7, alkali metal vapor is introduced through the metal exhaust tube 7 for forming and activating the photocathode 5 and the secondary emissive surface of the photomultiplier portion 8. Afterward the metal exhaust tube 7A is severed from the exhaust system using pinch-off seal and maximally shortened.

Because the sidewall 2A is made entirely from metal, radioactive materials contained within glass such as $K^{40}$ are not present so noise caused by such materials is prevented. Also even if floating electrons or ions generated in the electron multiplying process strike the sidewall 2A, the sidewall 2A does not emit light and thus noise is greatly reduced. Additionally, the metal side wall 2A serves to shield the photomultiplier tube from external electric and magnetic fields.

The sealing area 2*b* is aligned with the flange-like annular portion 11, then once aligned the two are welded together to form a vacuum seal using helium arc or resistance welding techniques. Because this method reduces production time, and amount of heat involved with production, deterioration of the multiplier assembly 8 caused by heat can be avoided.

Because the flared metal exhaust tube 7A is welded using resistance welding techniques and severed using pinch-off seal, the length of the flared metal exhaust tube 7A can be maximally reduced without generation or pooling of gas in the photomultiplier tube. Operation time can also be expected to reduce greatly. The envelope in the first embodiment is generally cylindrical, but can of course be angled.

Further advantages exist in the present invention in that commonly used metal caps used for making up electrical devices, such as capacitors, diodes, can be used for the metal envelope, whereby a mass-production of the photomultiplier tubes can be accomplished with reduced cost.

Figure 3A:
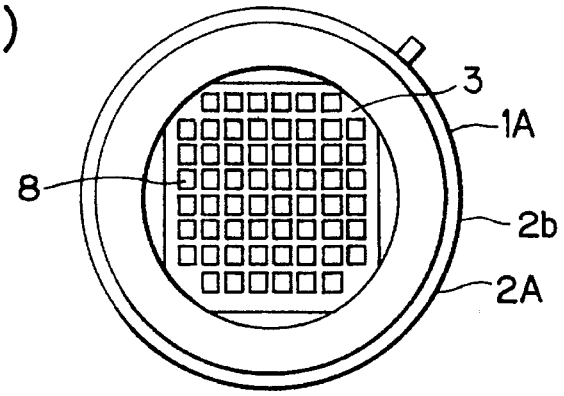
FIGS. 3(*a*), 3(*b*) and 3(*c*) are top plan view, cross-sectional side view and a bottom plan view, respectively, showing a photomultiplier tube according to a second embodiment of the present invention.
Figure 3B:
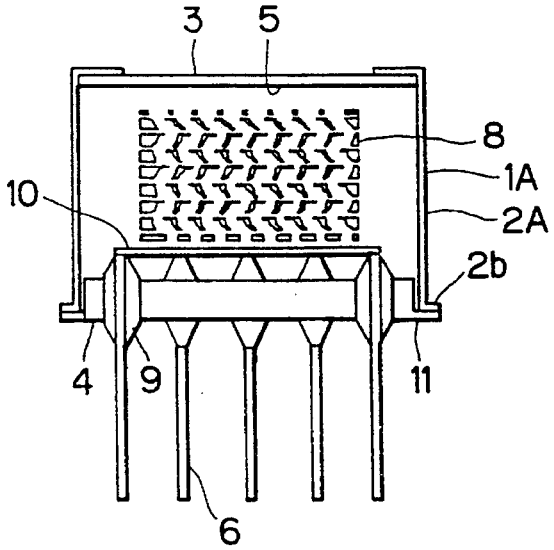
Figure 3C:
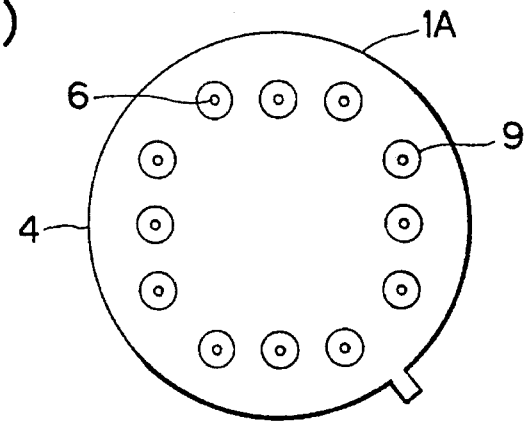

FIGS. 3(*a*) through 3(*c*) show a second preferred embodiment of the present invention. In this preferred embodiment, welding is performed under a vacuum so the metal exhaust tube 7A can be omitted. After formation of the photocathode 5 and the secondary electron emissive surfaces of the dynodes, indium seal or resistance welding is performed using a transfer unit to weld the sealing area 2*b* and the annular portion 11 together. Because the interior of the photomultiplier tube is a vacuum before the sealing area 2*b* and the annular portion 11 are welded together, if the seals are airtight, the interior of the photomultiplier tube will remain a vacuum even after the photomultiplier tube is moved to a standard atmosphere. Therefore there is no need to evacuate the interior of the photomultiplier tube and the flare-shaped metal exhaust tube 7A is unnecessary.

All advantages obtained with the first preferred embodiment can also be obtained in the second preferred embodiment. Additionally the second preferred embodiment allows omitting the metal exhaust tube 7A and a subsequent reduction in the number of required parts.

Figure 4A:
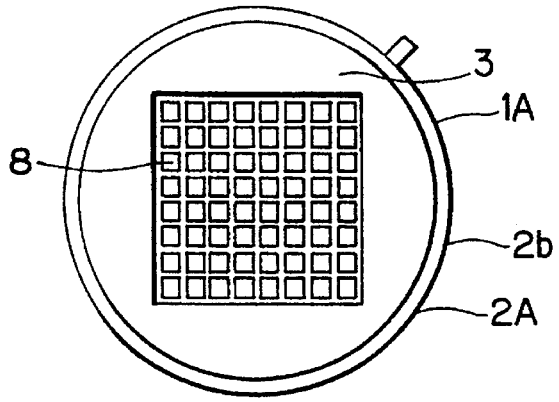
FIGS. 4(*a*), 4(*b*) and 4(*c*) are top plan view, cross-sectional side view and a bottom plan view, respectively, showing a photomultiplier tube according to a third embodiment of the present invention.
Figure 4B:
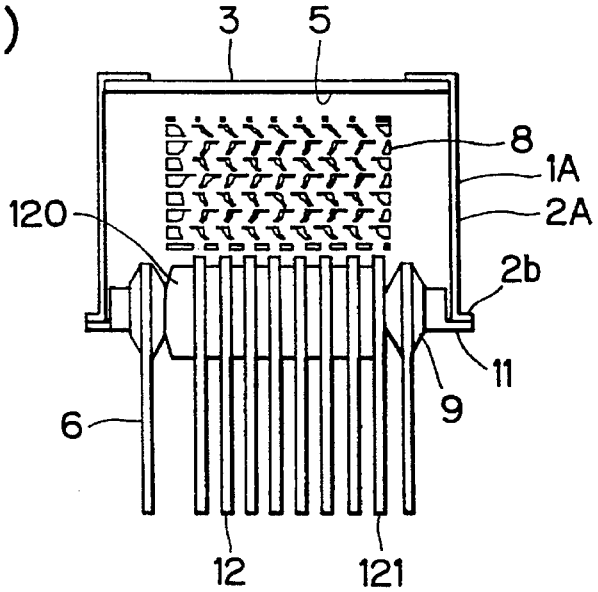
Figure 4C:
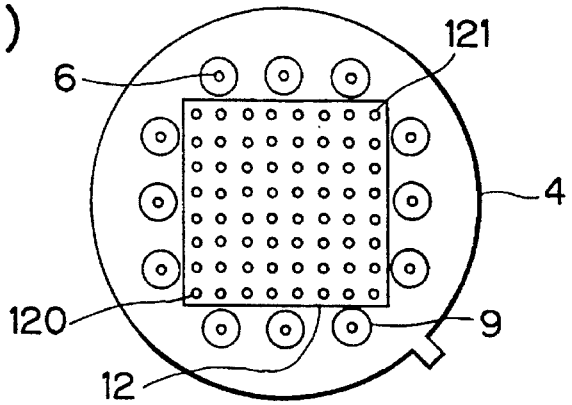

A third preferred embodiment of the present invention is shown in FIGS. 4(*a*) through 4(*c*). As can be seen from the figures, the plate-like anode electrode 10 of the first and second embodiments is replaced with a multianode 12 comprising rectangular shaped hermetic glass 120 for supporting the multianode 12 and a plurality of downwardly extending anode leads 121 which penetrate through the hermetic glass 120. In this embodiment, the multianode 12 is rectangular with the downwardly extending anode leads 121 formed in equidistant rows through the hermetic glass 120. The multianode 12 is fitted into a rectangular hole formed in the stem 4. In the figures, the anodes are arranged two-dimensionally but they may be arranged one-dimensionally.

The advantages obtained with the first and second preferred embodiments can also be obtained with the third preferred embodiment. Additionally the present invention according to the third preferred embodiment can be used to determine the position where light was incident upon the photomultiplier tube, e.g., by determining which anode leads 121 produce the greatest current. Because the current from the anode leads 121 varies depending upon the amount of incident light, the anode leads 121 which output the greatest current will be those directly beneath the position where light was incident upon the photomultiplier tube.

Figure 5A:
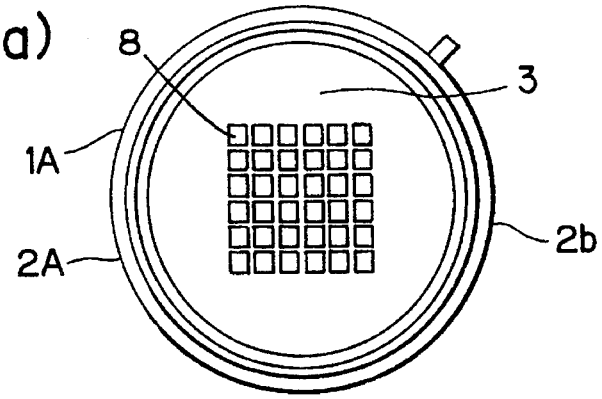
FIGS. 5(*a*), 5(*b*) and 5(*c*) are top plan view, cross-sectional side view and a bottom plan view, respectively, showing a photomultiplier tube according to a fourth embodiment of the present invention.
Figure 5B:
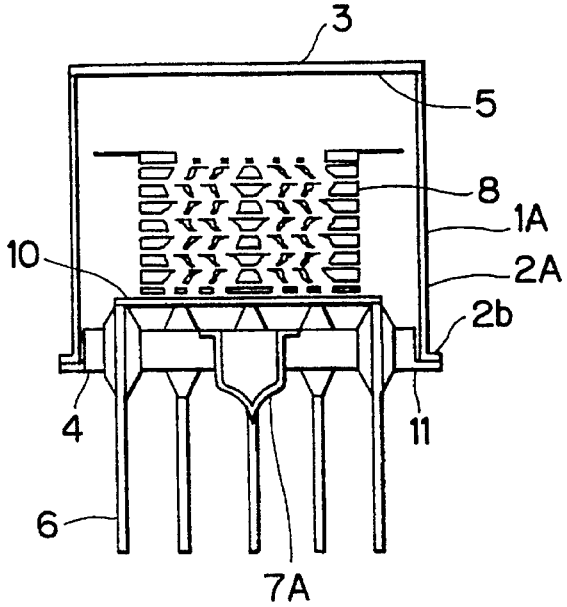
Figure 5C:
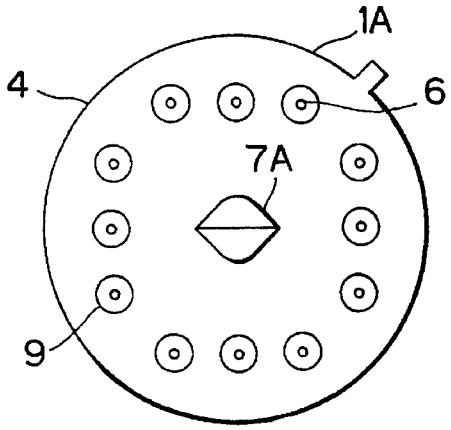

FIGS. 5(*a*) through 5(*c*) show a fourth embodiment of the present invention. In the fourth embodiment, the end of the sidewall 2A to which the faceplate 3 is attached has no inwardly radially protruding annular rim. Instead of the faceplate 3 being annularly airtight welded to the underside of the inwardly radially protruding annular rim, the faceplate 3 is airtight welded to the open end of the sidewall 2A.

The fourth embodiment obtains all the advantages of the embodiments described previously. Additionally, the fourth embodiment eliminates the annular rim of the sidewall 2A, thereby increasing the effective surface area of the photocathode 3. Also, because the pressure difference between the atmosphere and the evacuated interior of the photomultiplier tube urges the faceplate 3 towards the interior of the photomultiplier tube, and therefore naturally presses the faceplate 3 against the sidewall 2A, less surface area is required for airtight welding the faceplate 3 to the sidewall 2A than when the faceplate 3 is welded to the 10 underside of the radially inwardly protruding annular rim. This also greatly increases reliability of the airtight seal of the envelope 1A.

Figure 6A:
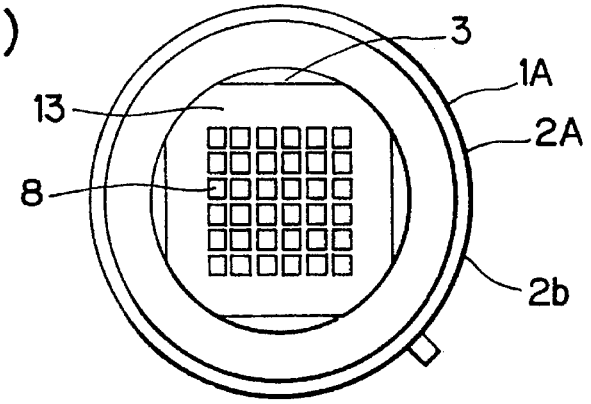
FIGS. 6(*a*), 6(*b*) and 6(*c*) are top plan view, cross-sectional side view and a bottom plan view, respectively, showing a photomultiplier tube according to a fifth embodiment of the present invention.
Figure 6B:
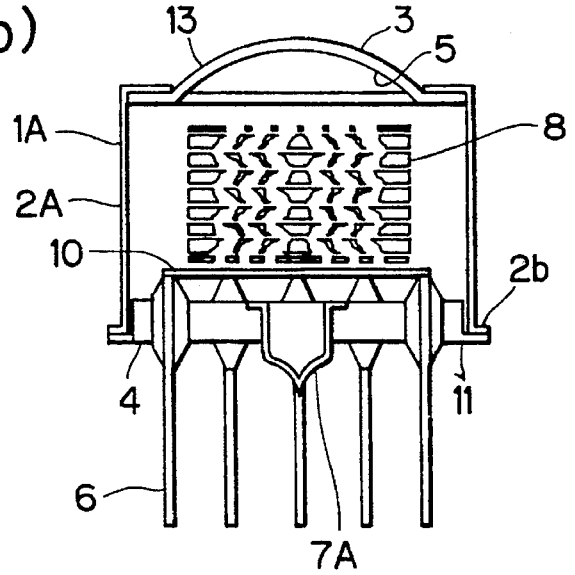
Figure 6C:
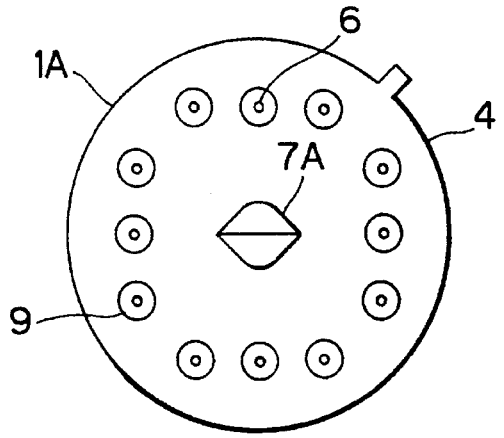

FIGS. 6(*a*) through 6(*c*) show a fifth embodiment of the present invention. In the fifth embodiment, the faceplate 3 is airtight welded to the underside of the radially inwardly protruding annular rim of the sidewall 2A as in the first through third embodiments, the difference being that the faceplate 3 includes a generally hemispherical portion 13 that protrudes away from the interior of the photomultiplier tube.

The fifth embodiment obtains all the advantages of the first through third embodiments. Additionally, the hemispherical portion 13 allows light angularly incident on the faceplate 3 to enter the photomultiplier tube instead of reflecting thereof.

Figure 7A:
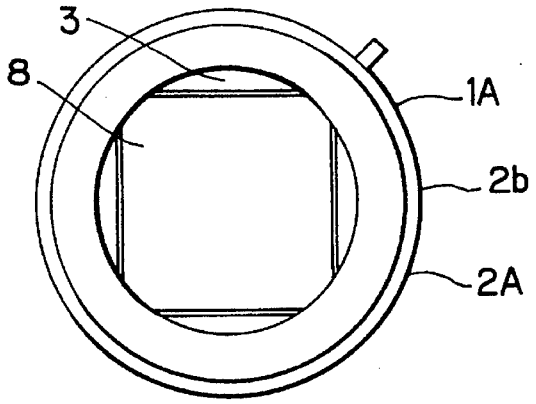
FIGS. 7(*a*), 7(*b*) and 7(*c*) are top plan view, cross-sectional side view and a bottom plan view, respectively, showing a photomultiplier tube according to a sixth embodiment of the present invention.
Figure 7B:
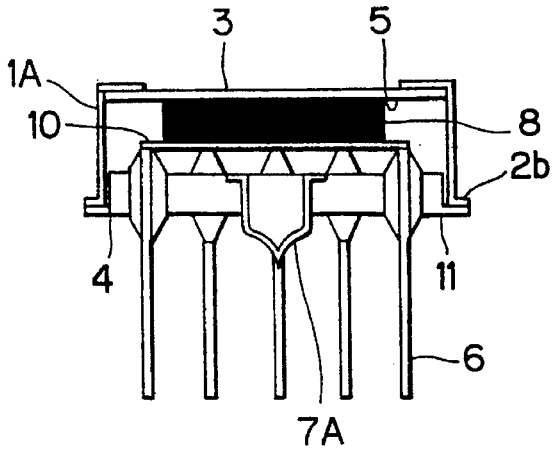
Figure 7C:
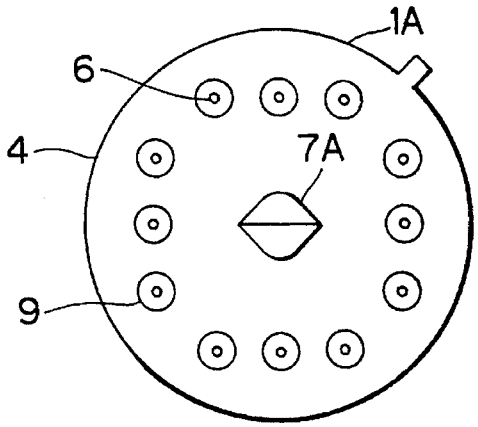

FIGS. 7(*a*) through 7(*c*) shows the present invention according to a sixth embodiment. In the sixth embodiment, the photomultiplier portion 8 is thinner and the vertical height of the envelope 1A reduced to conform to the vertical height of the thinner photomultiplier assembly 8. The photomultiplier assembly 8 can be made from multi-layered dynodes as in the previous embodiments or from microchannel plates or semiconductor elements. Because sealing the envelope 1A by applying resistance welding techniques leaves 10 the photomultiplier portion 8 almost unaffected by heat, such a vertically thin photomultiplier tube is possible. The sixth embodiment is particularly advantageous in that it reduces the amount of space taken up by the photomultiplier tube.

Figure 8A:
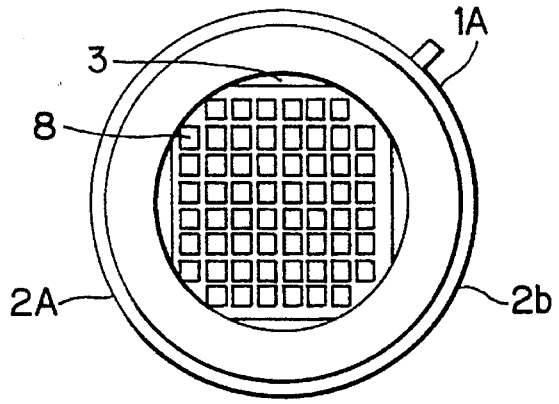
FIGS. 8(*a*), 8(*b*) and 8(*c*) are top plan view, cross-sectional side view and a bottom plan view, respectively, showing a photomultiplier tube according to a seventh embodiment of the present invention.
Figure 8B:
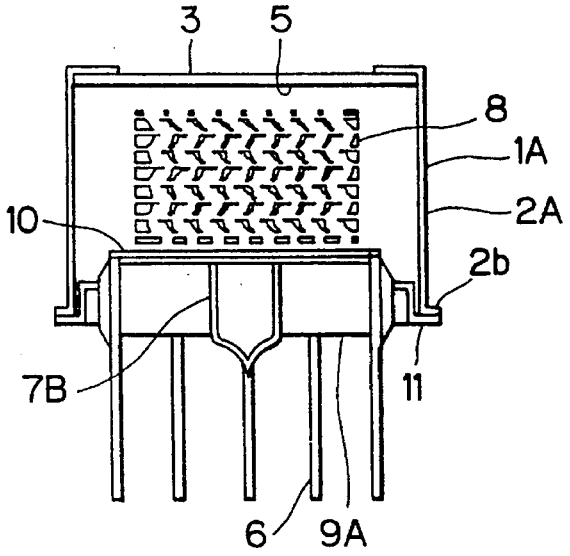
Figure 8C:
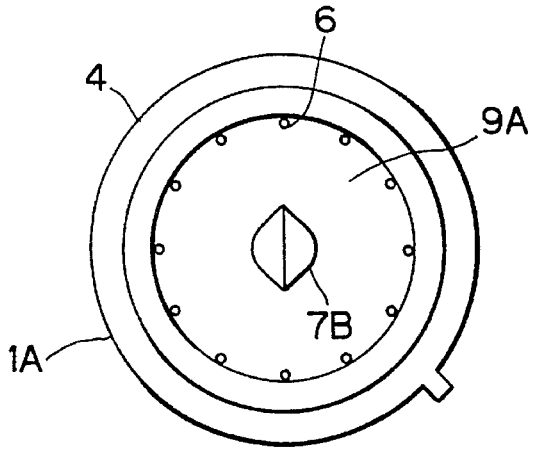

FIGS. 8(*a*) through 8(*c*) show a seventh embodiment of the present invention. In the seventh embodiment a generally circular hole is opened in the stem 4. Into the hole is fitted a large, generally circular, tapered hermetic glass 9A which meets the circular size of the hole. Positioned following the perimeter of the hermetic glass 9A are a plurality of leads which penetrate through the hermetic glass so one end of each lead is exposed to the interior of the photomultiplier tube and the other end is exposed to the exterior of the photomultiplier tube. In the center of the stem 4 is a metal exhaust tube 7A. The seventh embodiment is particularly advantageous in that manufacturing cost can be reduced by reducing the number of parts.

Figure 9A:
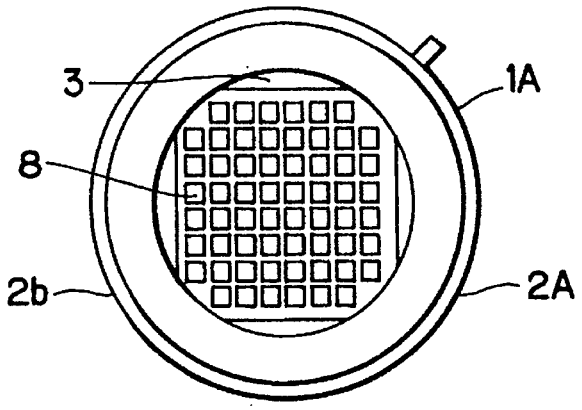
FIGS. 9(*a*), 9(*b*) and 9(*c*) are top plan view, cross-sectional side view and a bottom plan view, respectively, showing a photomultiplier tube according to an eighth embodiment of the present invention.
Figure 9B:
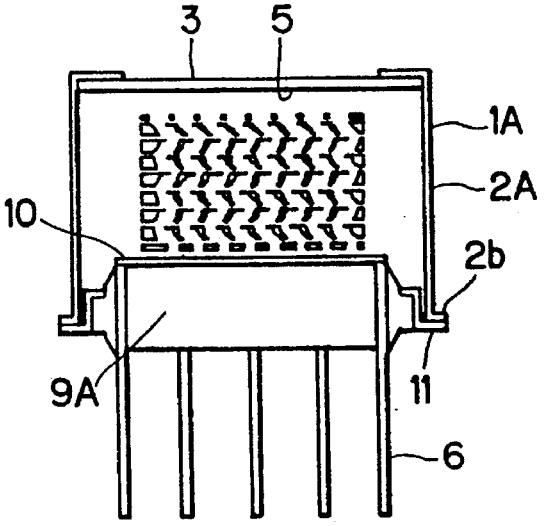
Figure 9C:
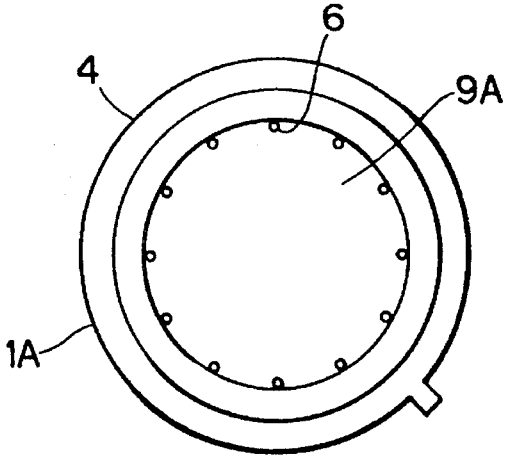

FIGS. 9(*a*) through 9(*c*) show an eighth embodiment of the present invention. The eighth embodiment is the same as the seventh embodiment except that in the eighth embodiment the metal exhaust tube 7A is omitted. In the eighth embodiment, as in the second embodiment, after formation of the photocathode 5 and the secondary electron emissive surface of the dynodes, indium seal or resistance welding is performed to weld the sealing area 2*b* and the flange-like annular portion 11 together. Because the interior of the photomultiplier tube is a vacuum before and after the sealing area 2*b* and the flange-like annular portion 11 are welded together, there is no need to evacuate the interior of the photomultiplier tube. Therefore the flare-shaped metal exhaust tube is unnecessary.

The eighth embodiment is particularly advantageous in that the manufacturing cost can be reduced by reducing the number of parts. Also because the metal exhaust tube 7A is omitted, the leads 6 can be more easily inserted into their appropriate sockets.

Because the sidewall 2A is made entirely from metal, noise caused by such radioactive materials contained within glass, such as $K^{40}$, is prevented. Also even if floating electrons or ions strike the metal sidewall 2A, light does not emanate from the side wall 2A, providing great reductions in noise.

The sealing area 2*b* is aligned with the flange-like annular portion 11, then once aligned the two are welded together using helium arc or resistance welding techniques to form a vacuum seal. Because this method reduces production time and amount of heat involved with production, quality problems related to heat can be avoided.

Because the flared metal exhaust tube 7A is welded using resistance welding techniques and severed using pinch-off Seal, the length of the flared metal exhaust tube 7A can be maximally reduced without generation or pooling of gas in the photomultiplier tube. Operation time can also be expected to reduce greatly.

Figure 10A:
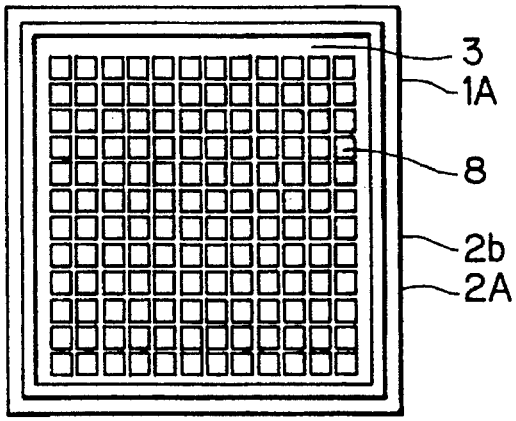
FIGS. 10(*a*), 10(*b*) and 10(*c*) are top plan view, cross-sectional side view and a bottom plan view, respectively, showing a photomultiplier tube according to a ninth embodiment of the present invention.
Figure 10B:
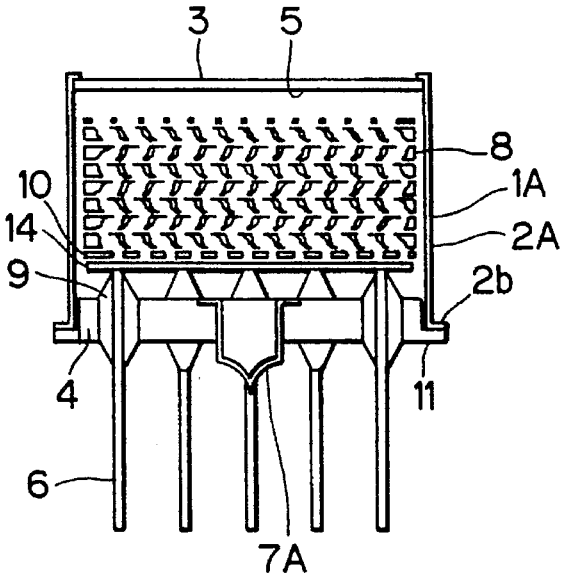
Figure 10C:
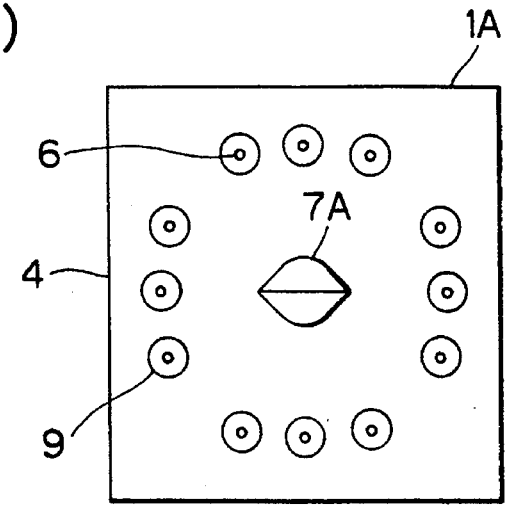
Figure 11A:
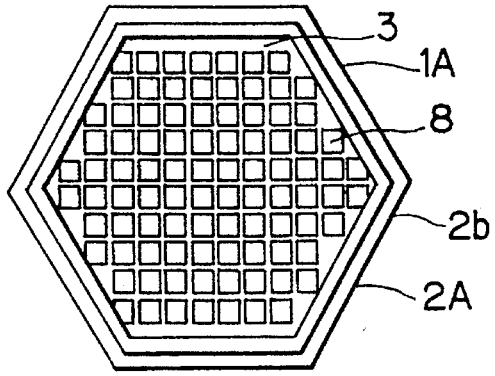
FIGS. 11(*a*), 11(*b*) and 11(*c*) are top plan view, cross-sectional side view and a bottom plan view, respectively, showing a photomultiplier tube according to tenth embodiment of the present invention.
Figure 11B:
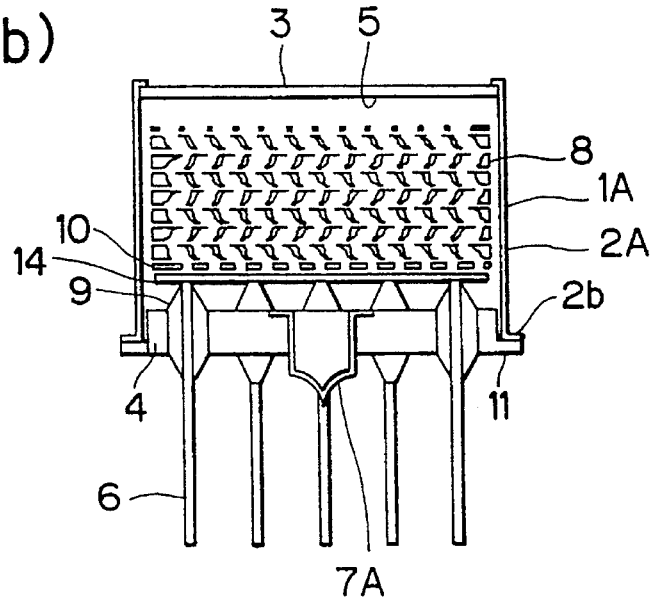
Figure 11C:
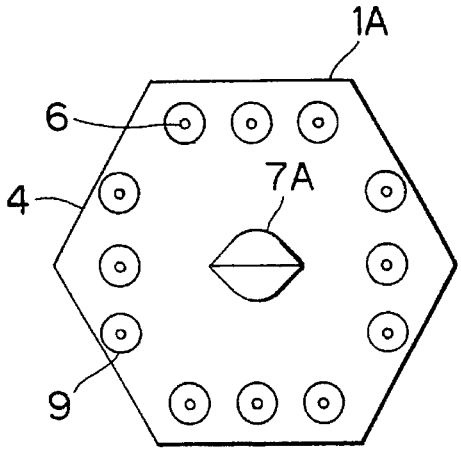

FIGS. 10(*a*) through 10(*c*) and FIGS. 11(*a*) through 11(*c*) show ninth and tenth embodiments of the present invention, respectively. The ninth embodiment is similar to the first embodiment shown in FIGS. 2(*a*) through 2(*c*) except the circular cross-section of the envelope 1A in the first embodiment is square in the ninth embodiment. The cross-section of-the envelope 1A may be rectangular. The tenth embodiment is also similar to the first embodiment shown in FIGS. 2(*a*) through 2(*c*) except the circular cross-section of the envelope 1A in the first embodiment is hexagon in the tenth embodiment.

The ninth and tenth embodiments are advantageous in that a plurality of photomultiplier tubes can be arranged without gaps forming therebetween as with circular cross-section photomultiplier tubes. Consequently less light passes between the photomultiplier tubes when tightly arranged one- or two-dimensionally and less light is lost.

Although the present invention has been described with respect to specific embodiments, it will be appreciated by one skilled in the art that a variety of changes and modification may be made without departing the scope of the invention. Certain features may be used independently of others and equivalents may be substituted all within the spirit and scope of the invention.

What is claimed is:

1. A photomultiplier tube comprising:

a metal sidewall made entirely of metal, and having first and second ends in a longitudinal direction, the second end of said metal sidewall having a flange-shaped sealing portion about the entire periphery thereof, said flange-shaped sealing portion having a first surface substantially normal to said longitudinal direction of said metal sidewall;

a transparent faceplate hermetically sealed to the first end of said metal sidewall, said faceplate having a surface;

a stem made of metal, and hermetically sealed to the second end of said metal sidewall, said metal sidewall, said faceplate and said stem forming an airtight chamber with the surface of said faceplate being directed inwardly of said airtight chamber, said stem having a metal, flange-shaped, airtight sealing section having a second surface facing and in contact with said first surface, said first surface of said sealing portion of said metal sidewall being hermetically sealed to said second surface of said sealing section of said stem about the entire periphery of said metal sidewall;

a photocathode formed on the surface of said faceplate for producing electrons in response to incident radiation thereon;

an electron multiplier assembly provided within the airtight chamber for multiplying the electrons relayed from said photocathode; and an anode for receiving multiplied electrons from said electron multiplier assembly and producing an output signal representative of the radiation incident on said photocathode.

2. The photomultiplier tube according to claim 1, further comprising a resistance weld which seals said sealing portion of said metal sidewall and said sealing section of said stem together.

3. The photomultiplier tube according to claim 1, further comprising a metal exhaust tube formed in said stem, said metal exhaust tube being sealed and maximally shortened after gaseous matter within said airtight chamber is evacuated.

4. The photomultiplier tube according to claim 3, wherein said metal exhaust tube comprises a pinch-off sealing section which seals said metal exhaust tube.

5. The photomultiplier tube according to claim 1, wherein said electron multiplier assembly comprises a plurality of dynodes arranged in a predetermined number of stages in the longitudinal direction of said metal sidewall, each stage including a predetermined number of dynodes being in one-dimensional array.

6. The photomultiplier tube according to claim 1, wherein said electron multiplier assembly comprises a plurality of dynodes arranged in a predetermined number of stages in the longitudinal direction of said metal sidewall, each stage including a predetermined number of dynodes arranged two-dimensionally in a matrix form.

7. The photomultiplier tube according to claim 1, wherein said anode includes a plurality of plate-shaped anode elements for receiving the electrons from said electron multiplier assembly, and a plurality of electrically isolated leads connected in one-to-one correspondence to said plurality of plate-shape anode elements, said plurality of leads being sealed through said stem.

8. The photomultiplier tube according to claim 7, wherein said leads are electrically isolated by glass.

9. The photomultiplier tube according to claim 1, wherein said anode includes a plurality of electrically isolated leads sealed through said stem and arranged in a matrix array.

10. The photomultiplier tube according to claim 1, wherein the first end of said metal sidewall is provided with an annular, radially inwardly protruding portion with a surface confronting the airtight chamber, said faceplate being hermetically sealed to the surface.

11. The photomultiplier tube according to claim 1, wherein said faceplate is generally hemispheric for allowing angular incident light to pass through.

12. The photomultiplier tube according to claim 1, wherein said electron multiplier assembly includes a microchannel plate.

13. The photomultiplier tube according to claim 1, wherein said electron multiplier assembly includes a semiconductor device.

14. The photomultiplier tube according to claim 1, wherein said metal sidewall has a circular cross-section.

15. The photomultiplier tube according to claim 1, wherein said metal sidewall has a square cross-section.

16. The photomultiplier tube according to claim 1, wherein said metal sidewall has a rectangular cross-section.

17. The photomultiplier tube according to claim 1, wherein said metal sidewall has a hexagon cross-section.

18. The photomultiplier tube according to claim 1, wherein said stem has a plurality of hermetic glasses and a plurality of pins extending through respective ones of said plurality of hermetic glasses individually, for supplying voltages to said photocathode, said electron multiplier assembly and said anode.

19. The photomultiplier tube according to claim 1, wherein said sealing portion and said sealing section each extend radially outward beyond said sidewall.

20. A photomultiplier tube comprising:

a metal sidewall having first and second ends in a longitudinal direction, the second end of said metal sidewall including a flange-shaped sealing portion about the entire periphery thereof, said flange-shaped sealing portion having a first surface substantially normal to said longitudinal direction of said metal sidewall;

a transparent faceplate hermetically sealed to the first end of said metal sidewall, said faceplate having a surface;

a stem including a metal flange-shaped, airtight sealing section having a second surface facing and in contact with said first surface, said first surface of said sealing portion of said metal sidewall being hermetically sealed to said second surface of said sealing section of said stem about the entire periphery of said metal sidewall, said metal sidewall, said faceplate and said stem forming an airtight chamber with the surface of said faceplate being directed inwardly of said airtight chamber;

a photocathode formed on the surface of said faceplate for producing electrons in response to incident radiation thereon;

an electron multiplier assembly provided within the airtight chamber for multiplying the electrons relayed from said photocathode, said electron multiplier assembly comprising a plurality of dynodes arranged in a predetermined number of stages in the longitudinal direction of said metal side wall, each stage including a predetermined number of dynodes;

an anode for receiving multiplied electrons from said electron multiplier assembly and producing an output signal representative of the radiation incident on said photocathode, said anode including a plurality of plate-shaped anode elements and a plurality of electrically isolated leads connected in one-to-one correspondence to said plurality of plate-shaped anode elements, said plurality of leads being sealed through said stem; and a metal exhaust tube formed in said stem, said metal exhaust tube being sealed and maximally shortened after gaseous matter within said airtight chamber is evacuated.

21. The photomultiplier tube according to claim 20, further comprising a resistance weld which seals said sealing portion of said metal sidewall and said sealing section of said stem together.

22. The photomultiplier tube, according to claim 20, wherein said metal exhaust tube comprises a pinch-off sealing section which seals said metal-exhaust tube.

23. The photomultiplier tube according to claim 20, wherein said predetermined number of dynodes are in one-dimensional array.

24. The photomultiplier tube according to claim 20, wherein said predetermined number of dynodes are arranged two-dimensionally in a matrix form.

25. The photomultiplier tube according to claim 20, wherein said sealing portion and said sealing section each extend radially outward beyond said sidewall.

26. A photomultiplier tube comprising:

a sidewall made entirely of metal, and having first and second ends in a longitudinal direction, the first end being formed with a radially inwardly protruding annular rim, said annular rim having an inner surface, the second end of said metal sidewall having an outwardly-protruding, flange-shaped annular sealing portion;

a transparent faceplate hermetically sealed to the inner surface of said annular rim, said faceplate having a surface;

a stem made of metal, and having a metal flange-shaped, sealing section hermetically sealed to said sealing portion of said metal side wall, said metal sidewall, said faceplate and said stem forming an airtight chamber with the surface of said faceplate being directed inwardly of said airtight chamber, said stem having a plurality of tapered hermetic glasses distributed substantially in a rectangular pattern on said stem, and a plurality of stem leads extending through respective ones of said plurality of hermetic glasses individually;

a photocathode formed on the surface of said faceplate for producing electrons in response to incident radiation thereon;

a plurality of dynodes arranged in the longitudinal direction in a predetermined number of stages, and provided within the airtight chamber for multiplying the electrons relayed from said photocathode; and an anode for receiving multiplied electrons from said electron multiplier assembly and producing an output signal representative of the radiation incident on said photocathode, wherein said plurality of stem leads supply voltages to said photocathode, said plurality of dynodes, and said anode.

27. The photomultiplier tube according to claim 26, wherein said sealing portion and said sealing section each extend radially outward beyond said sidewall.

28. A photomultiplier tube comprising:

a sidewall made entirely of metal having first and second ends in a longitudinal direction;

a faceplate hermetically sealed to said first end of said sidewall and having a surface;

a stem made of metal and hermetically sealed to said second end of said sidewall, said sidewall, said faceplate and said stem forming an airtight chamber with said surface of said faceplate being directed inwardly of said airtight chamber, said stem having a plurality of tapered hermetic glasses distributed therein, and a plurality of stem leads extending through respective ones of said plurality of hermetic glasses individually;

a photocathode formed on said surface of said faceplate which produces electrons in response to incident radiation thereon;

a device provided within the airtight chamber for multiplying the electrons relayed from said photocathode; and an anode which receives said multiplied electrons from said device and produces an output signal representative of the radiation incident on said photocathode, wherein said plurality of stem leads supply voltages to said photocathode, said device, and said anode.

29. A photomultiplier tube comprising:

a sidewall having first and second ends in a longitudinal direction, the second end of said sidewall including a flange-shaped sealing portion about the entire periphery thereof, said flange-shaped sealing portion having a first surface substantially normal to said longitudinal direction of said sidewall;

a transparent faceplate hermetically sealed to the first end of said sidewall, said faceplate having a surface;

a stem including a flange-shaped, airtight sealing section having a second surface facing and in contact with said first surface, said first surface of said sealing portion of said sidewall being hermetically sealed to said second surface of said sealing section of said stem about the entire periphery of said sidewall, said sidewall, said faceplate and said stem forming an airtight chamber with the surface of said faceplate being directed inwardly of said airtight chamber, said stem further comprising a plurality of tapered hermetic glasses distributed therein, and a plurality of stem leads extending through respective ones of said plurality of hermetic glasses individually;

a photocathode formed or the surface of said faceplate for producing electrons in response to incident radiation thereon;

a device provided within the airtight chamber which multiplies the electrons relayed from said photocathode; and an anode for receiving multiplied electrons from said device and producing an output signal representative of the radiation incident on said photocathode;

said plurality of stem leads supplying voltages to said photocathode, said device and said anode.

30. A photomultiplier tube comprising:

a sidewall made entirely of metal having first and second ends in a longitudinal direction, the second end of said sidewall including a flange-shaped sealing portion about the entire periphery thereof, said flange-shaped sealing portion having a first surface substantially normal to said longitudinal direction of said sidewall;

a faceplate hermetically sealed to said first end of said sidewall and having a surface;

a stem comprising:

a plurality of tapered hermetic glasses distributed therein, and a plurality of stem leads extending through respective ones of said plurality of hermetic glasses individually; and a flange-shaped, airtight sealing section having a second surface facing and in contact with said first surface, a resistance weld hermetically seals said first surface of said sealing portion of said sidewall to said second surface of said sealing section of said stem together about the entire periphery of said sidewall, said sidewall, said faceplate and said stem forming an airtight chamber with the surface of said faceplate being directed inwardly of said airtight chamber, said sealing portion and said sealing section of each extending radially outward beyond said sidewall, a photocathode formed on said surface of said faceplate which produces electrons in response to incident radiation thereon;

a device provided within the airtight chamber for multiplying the electrons relayed from said photocathode; and an anode which receives said multiplied electrons from said device and produces an output signal representative of the radiation incident on said photocathode, wherein said plurality of stem leads supply voltages to said photocathode said device, and said anode.

* * * * *